US010107003B1

(12) United States Patent
Harmer

(10) Patent No.: US 10,107,003 B1
(45) Date of Patent: Oct. 23, 2018

(54) SYSTEMS AND METHODS FOR SELF-STANDING, SELF-SUPPORTING, RAPID-DEPLOYMENT, MOVABLE COMMUNICATIONS TOWERS

(71) Applicant: Adaptive Communications LLC, Delta, CO (US)

(72) Inventor: Tracy David Harmer, Delta, CO (US)

(73) Assignee: ADAPTIVE COMMUNICATIONS LLC, Delta, CO (US)

( * ) Notice: Subject to any disclaimer, the term of this patent is extended or adjusted under 35 U.S.C. 154(b) by 0 days.

(21) Appl. No.: 15/476,610

(22) Filed: Mar. 31, 2017

(51) Int. Cl.

| | |
|---|---|
| ***E04H 12/20*** | (2006.01) |
| ***E04H 12/10*** | (2006.01) |
| ***E04H 12/18*** | (2006.01) |
| ***E04H 12/34*** | (2006.01) |
| *E04H 12/00* | (2006.01) |

(52) U.S. Cl.
CPC ..... *E04H 12/20* (2013.01); *E04H 12/10* (2013.01); *E04H 12/18* (2013.01); *E04H 12/34* (2013.01); *E04H 2012/006* (2013.01)

(58) Field of Classification Search
CPC ... E04H 12/10; E04H 12/18; E04H 2012/006; E04H 12/06; E04H 12/34; E04H 12/02
USPC ..... 52/651.02, 651.03, 651.08, 651.1
See application file for complete search history.

(56) References Cited

U.S. PATENT DOCUMENTS

| | | | | |
|---|---|---|---|---|
| 471,373 | A * | 3/1892 | Beard et al. | E04H 12/10 403/217 |
| 826,996 | A * | 7/1906 | Cook | E02D 27/02 52/292 |
| 1,105,777 | A * | 8/1914 | Haskell | E04H 12/10 52/651.03 |
| 1,953,488 | A * | 4/1934 | Knutsen | D06F 53/04 52/651.03 |
| 3,550,146 | A * | 12/1970 | Eberle | E04H 12/10 343/879 |
| 3,796,018 | A * | 3/1974 | Holmstrom | B66C 23/286 403/349 |
| 4,934,114 | A * | 6/1990 | Lindsey | E04H 12/10 403/363 |
| 6,050,038 | A | 4/2000 | Fey et al. | |
| 9,677,334 | B2 * | 6/2017 | Aiken | E06C 5/04 |
| 2005/0166521 | A1 * | 8/2005 | Silber | E04H 12/10 52/633 |
| 2011/0126488 | A1 * | 6/2011 | Hedinger | H01Q 1/1207 52/651.09 |
| 2011/0258960 | A1 * | 10/2011 | Daas | E04B 1/3441 52/646 |
| 2011/0283640 | A1 * | 11/2011 | Miller | E02D 27/42 52/292 |
| 2012/0298449 | A1 * | 11/2012 | Kreller | E04G 1/14 182/113 |

(Continued)

*Primary Examiner* — Brian D Mattei
(74) *Attorney, Agent, or Firm* — Sheridan Ross P.C.

(57) ABSTRACT

The present disclosure relates to systems and methods for providing self-standing, self-supporting, rapid-deployable (S4RD) towers for communications and similar applications, and in particular to ballast base systems that enable the self-standing, self-supporting, rapid-deployable features while eliminating the need for a permanent foundation for the tower. Novel and inventive tower designs, wherein a user may climb through an interior volume of the tower while using the tower structure as both ladder and man cage, are also disclosed.

20 Claims, 9 Drawing Sheets

(56) References Cited

U.S. PATENT DOCUMENTS

2013/0283726 A1* 10/2013 Chaput ..... B66F 3/46
52/745.17
2016/0194896 A1* 7/2016 Pondorfer ..... E04H 12/344
52/745.18

* cited by examiner

SYSTEMS AND METHODS FOR SELF-STANDING, SELF-SUPPORTING, RAPID-DEPLOYMENT, MOVABLE COMMUNICATIONS TOWERS

FIELD OF THE INVENTION

The present invention is generally directed toward systems and methods for providing communications towers, and particularly directed toward communications towers that are self-standing, self-supporting, movable, and capable of being deployed rapidly.

BACKGROUND OF THE INVENTION

As wireless networks for a wide variety of applications continue to grow and expand, the identification of suitable locations for new communications towers is becoming increasingly important. Often, the most suitable locations are on private property, especially in the case of wireless Internet and telephone networks in rural areas, where communications towers on, for example, farm or ranch land may be necessary or desirable.

Despite the need for expansion of wireless networks, particularly in rural areas, conventional communications towers continue to suffer from several drawbacks that make their placement on private property impractical. Towers of the prior art require extensive foundation and ground work, including the excavation of numerous large holes and the placement of significant quantities of rebar and/or concrete, which is undesirable to many property owners who would prefer not to erect such a significant and permanent foundation. A permanent foundation may be especially undesirable when the need for the communications tower is temporary and/or when it may be advantageous for the tower to be moved rapidly or frequently, such as in the cases of, by way of non-limiting example, natural disasters or other emergencies, military operations, and sporting events. Additionally, it is often necessary or desirable to place communications towers on terrain that is rugged, remote, or otherwise largely inaccessible to excavation and construction equipment.

Attempts to overcome these obstacles have largely focused on lower-end self-standing or guyed towers with lesser foundation requirements, but such towers suffer from additional drawbacks. Particularly, current self-standing or guyed towers generally have a very small structure, often being less than 18 inches wide and having pole diameters of one inch or less. As a result, such towers are difficult for a technician to climb to place antennas. Moreover, such small towers lack rigidity and so may move or twist due to wind and ground disturbances; the point-to-point backhaul antennas typical of many communications networks utilize very narrow radio beams and so require extremely precise placement, and as a result the shifting, twisting, or movement of the towers on which the antennas are mounted may significantly degrade bandwidth and network performance.

One solution that has recently been attempted is the so-called "gravity pad," which generally comprises a steel channel structure that is bolted together, a metal plate underlying and bolted the steel channel structure, and square concrete blocks disposed inside the cavities created by the crisscrossed steel channel structure, whereby a monopole or other tower may be bolted to the gravity pad. While gravity pads do not require a permanent foundation, they must be assembled on-site by bolting together a large number of individual pieces, and even after assembly comprise many disparate components, i.e. the steel channel/plate structure and the concrete blocks. In addition, when the tower is subjected to wind or another extrinsic bending load, the entire load is transmitted to the base at a single connection point, requiring a very heavy base to prevent the connection between the tower and the base from breaking.

There is thus a need in the art for communications towers that are significantly self-standing and self-supporting, thereby requiring little or no foundation or ground work for installation, and that can be easily installed on rugged or remote terrain, while also providing sufficient size and rigidity to remain substantially stationary when exposed to wind or other extrinsic forces and to enable a technician to climb and maintain the tower and antennas mounted thereon. It is further advantageous for such communications towers to be capable of rapid deployment and easy relocation, as may be necessary for various applications. Means for securing the tower that are simple, lighter than previous attempts, provided as one or a small number of separate components, and easy to assemble either on- or off-site are further desirable.

SUMMARY OF THE INVENTION

It is one aspect of the present invention to provide a ballast base system for a tower, comprising at least one ballast base block, having a weight of at least about 2,500 pounds; and at least one pendant support, interconnecting the at least one ballast base block to an upper portion of the tower, wherein the at least one ballast base block and the at least one pendant support are configured such that the weight of the ballast base block is imparted as a downward force on the upper portion of the tower, the downward force sufficient to provide a pre-load onto the Ballast Base system that provides stiffness and to overcome an overturning moment imparted on the tower by a sustained wind of at least about 60 miles per hour.

In embodiments, the at least one ballast base block may comprise a cylinder made substantially of concrete, the cylinder having a diameter of about 60 inches, a height of about 20 inches, and a weight of about 5,000 pounds. The ballast base system may comprise four ballast base blocks, configured to be arranged in a square pattern around a circumference of the tower with one ballast base block at each vertex of the square pattern, the sides of the square pattern each having a length, as measured between centers of the respective ballast base blocks, of about 16 feet; and/or the ballast base system may comprise four ballast base blocks, configured to be arranged in a square pattern around a circumference of the tower with one ballast base block at each vertex of the square pattern, the sides of the square pattern each having a length, as measured between centers of the respective ballast base blocks, of about 30 feet; and/or the ballast base system may comprise eight ballast base blocks, configured to be arranged in a pattern of two concentric squares around a circumference of the tower with one ballast base block at each vertex of each square, the sides of an inner square each having a length, as measured between centers of the respective ballast base blocks, of about 30 feet and the sides of an outer square each having a length, as measured between centers of the respective ballast base blocks, of about 44 feet.

In embodiments, the at least one ballast base block may comprise a cylinder made substantially of concrete, the cylinder having a diameter of about 96 inches, a height of about 12 inches, and a weight of about 7,500 pounds. The ballast base system may comprise one ballast base block, configured to be disposed directly below the tower.

In embodiments, the at least one ballast base block may comprise a liquid bladder containing at least one liquid selected from the group consisting of water, a glycol, and an oil.

In embodiments, the at least one ballast base block may have a substantially circular or L-shaped horizontal cross-section.

In embodiments, a single ballast base used in conjunction with a shorter tower section, allows for dispensing with at least one pendant support. The shorter tower section is bolted directly to a single ballast base. Such a configuration permits use of the thread of the fourth anchor bolt to adjust the tower to level the ballast base. This configuration, in which the ballast base is connected directly to the tower, permits for sufficient stability without use of downforce.

In embodiments, the at least one pendant support comprises at least one member selected from the group consisting of a steel I-beam, a steel member other than an I-beam, a steel tube member, a graphite composite member, and a fiberglass member.

It is another aspect of the present invention to provide a four-sided tower structure, comprising a ladder face, comprising a plurality of rungs, the rungs spaced apart at vertical intervals of no more than about 12 inches; and three structural faces, wherein the ladder face and the three structural faces enclose a rectangular interior volume having a width of between about 27 and about 32 inches and a depth of between about 27 and about 32 inches, wherein a user may climb the ladder while occupying the rectangular interior volume, whereby the three structural faces may act as a man cage for the user while climbing the ladder.

In embodiments, the rungs of the ladder face may be spaced apart at vertical intervals of about 10.5 inches.

In embodiments, the tower structure may be a steel lattice tower structure. The ladder face may further comprise a vertical frame and each of the structural faces may comprise a vertical frame and a plurality of horizontal and diagonal supports, wherein the vertical frames comprise 2-inch square steel tubing and the rungs of the ladder face and the horizontal and diagonal supports comprise 1-inch square steel tubing.

In embodiments, the tower structure may further comprise at least one horizontal platform at a height above ground level, enabling the user to stand securely at the height.

In embodiments, the tower structure may comprise at least two modular, selectively interconnected tower sections.

In embodiments, the tower structure may be selected from the group consisting of a communications tower, a control tower, a light tower, and an observation tower.

In embodiments, the tower structure may be at least one of movable and portable.

It is another aspect of the present invention to provide a method for securing a tower to a ground surface and maintaining the tower in an upright position, comprising providing (i) at least one ballast base block having a weight of at least about 2,500 pounds and (ii) at least one pendant support adapted to interconnect the at least one ballast base block to an upper portion of the tower; arranging the at least one ballast base block on the ground surface at a tower site in a predetermined configuration; and affixing a base of the tower to the at least one pendant support, wherein the at least one ballast base block and the at least one pendant support are configured such that, after step (c), the weight of the ballast base block is imparted as a downward force on the upper portion of the tower, the downward force sufficient to provide a pre-load onto the Ballast Base system that provides stiffness and to overcome an overturning moment imparted on the tower by a sustained wind of at least about 60 miles per hour, wherein, after step (c), the tower is substantially self-standing and self-supporting, and wherein the method is completed in no more than about 3 hours.

In embodiments, the method may be completed in between about 90 minutes and about 2 hours.

In embodiments, the affixing step may be at least partially performed by a crane.

One advantage of the present invention is in in the self-standing, self-supporting nature of the communications towers provided. Such towers can also be deployed rapidly and repositioned on short notice, as may be desirable in, for example, emergencies such as natural disasters, and as a result may be considered self-standing, self-supporting, rapid-deployable (S4RD) communications towers. Communications towers of the present invention thus provide a flexible, cost-effective option for providing carrier grade telecommunications systems.

Ballast base systems of the present invention generally require no site excavation, foundation forming, rebar work, or concrete pouring; the most ground work that is required is placement of a surface layer of gravel or road base if the underlying ground is soggy or unstable. The ballast base system enables towers to be placed on ground with at least some degree of unevenness; generally, about 3 inches' difference between maximum and minimum height is permissible. As a result of the simple and non-permanent installation allowed by the ballast base system, the need for building permits is often eliminated or reduced.

Towers, including communications towers, of the present invention alleviate the need to invest significant time and money in the construction of a permanent tower foundation that prevents the tower from being moved or used at another location, and are much more feasible for installation on rugged or remote terrain. Additionally, communications towers of the present invention may be deployed to a desired location in a matter of minutes or hours, generally without the need to obtain building permits or utilize heavy excavation or construction equipment. By way of non-limiting example, communications towers of the present invention may be disassembled at one location, loaded onto a standard-size flatbed trailer or similar towing or transportation means, transported to a second location, and reassembled in the space of several hours or a day.

BRIEF DESCRIPTION OF THE DRAWINGS

The present disclosure is described in conjunction with the appended figures.

Figure 1A:
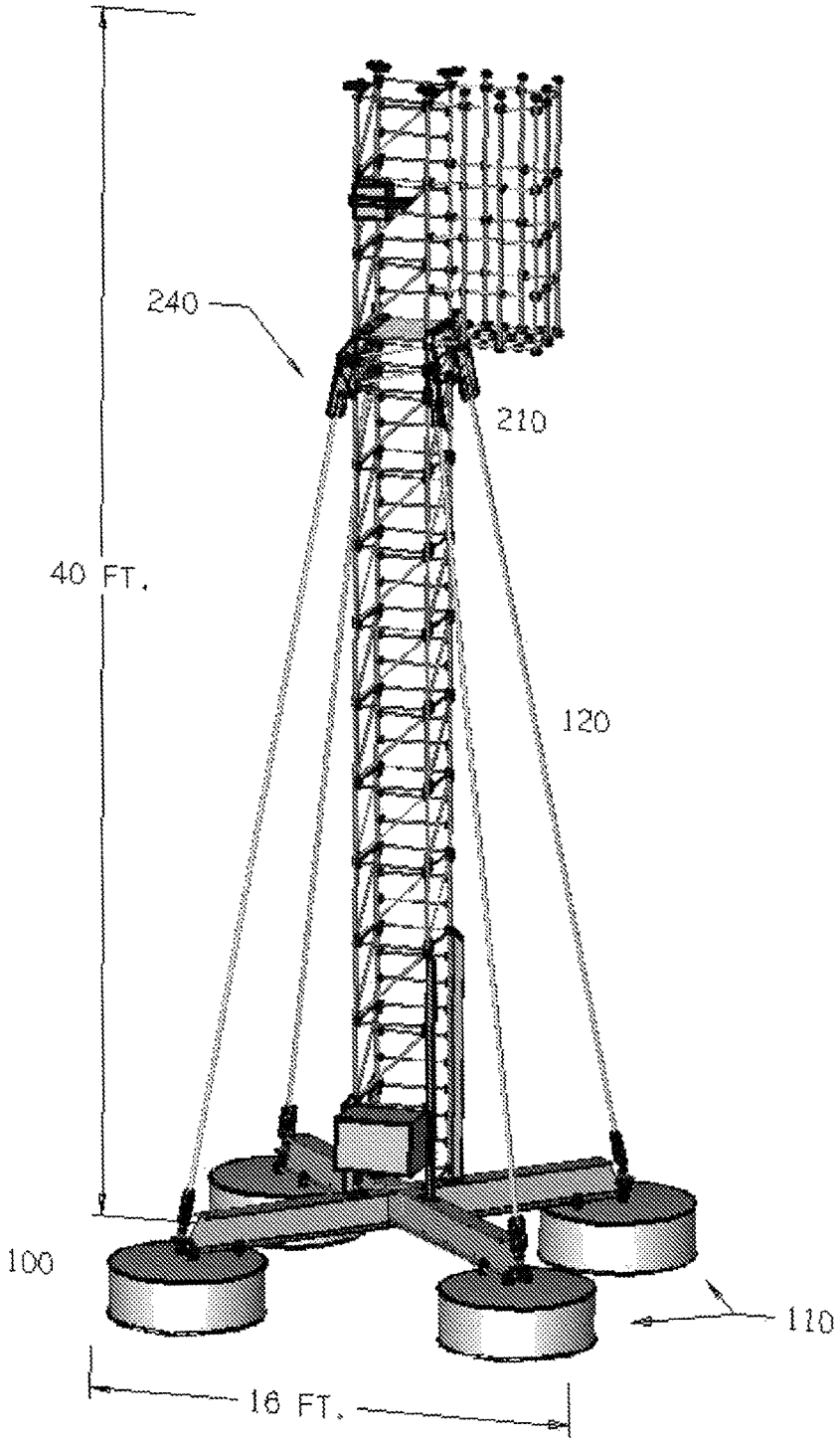
FIGS. 1A, 1B, and 1C are illustrations of towers of 40 feet, 52 feet, and 80 feet, respectively, in height and ballast base systems, according to embodiments of the present invention.

Drawings are not necessarily to be interpreted as being drawn to scale, or to any one particular scale.

DETAILED DESCRIPTION OF THE INVENTION

The ensuing description provides embodiments only, and is not intended to limit the scope, applicability, or configuration of the claims. Rather, the ensuing description will provide those skilled in the art with an enabling description for implementing the embodiments. It should be understood that various changes may be made in the function and arrangement of elements without departing from the spirit and scope of the appended claims.

As used herein, the term "backhaul" refers to that portion of a telecommunications network that provides an intermediate link between a core or backbone network and an edge subnetwork or user.

As used herein, the term "ballast base" refers to any base for a tower that includes sufficient ballast or weight, and is held stationary at a sufficient distance from the tower, to provide support to the tower to enable the tower to be self-supporting. A ballast base provides structural support to a tower sufficient to provide a pre-load onto the Ballast Base system that provides stiffness and to offset an overturning moment imparted on the tower by, for example, wind, and is generally provided in lieu of a tower foundation.

As used herein, the terms "carrier class" and "carrier grade" are interchangeable and each refer to a telecommunications system, or a hardware or software component thereof, capable of providing at least 99.999% availability, i.e. having maximum daily downtime of 0.8640 seconds or maximum weekly downtime of 6.048 seconds or maximum yearly downtime of 5.256 minutes. A carrier grade communications tower is generally engineered to remain substantially rigid in high winds and to support a significant number of antennas or aerials. Most towers used by, among others, cellular or wireless telephone service providers, militaries, and commercial radio and television stations are carrier grade communications towers.

As used herein, the term "communications tower" refers to any tower adapted to support at least one antenna or aerial for use in telecommunications and/or broadcasting. A communications tower may be self-supporting or cantilevered, or it may be supported by stays or guys.

As used herein, the term "control tower" refers to any tower having an enclosed or covered observation platform at its top that enables at least one person to monitor aircraft activities at an airport. A control tower may be either temporary or permanent, and is also an "observation tower" as that term is used herein.

As used herein, the term "light tower" refers to any permanent or temporary tower adapted to support at least one light on its perimeter. Applications of light towers include but are not limited to temporary lighting, emergency lighting, and mining lighting.

As used herein, the term "man cage" refers to any structure surrounding and enclosing a ladder that enables a user to ascend and descend on the ladder in a space between the ladder and the man cage, while also providing a safety measure to break, slow, and/or prevent the user's fall from the ladder.

As used herein, the term "movable tower" refers to any tower that can be disconnected and/or disassembled in less than 12 hours, loaded onto a standard-size truck or trailer or other similar transportation means, transported to another location, and reassembled, reconnected and/or configured for operation in less than 12 hours.

As used herein, the term "observation tower" refers to any tower having an enclosed or covered observation platform at its top that enables at least one person to observe and monitor the movement of people and/or objects in the vicinity. Examples of observation towers include, but are not limited to, control towers, fire spotting towers, and guard or watch towers at prisons and other secure facilities.

As used herein, the terms "pendant support" and "guy rod" are interchangeable and refer to any steel tubing member that connects an upper portion of a tower to a ballast base. A pendant support/guy rod is configured to transmit a downward force from the ballast base to the upper portion of the tower.

As used herein, the term "portable tower" refers to any tower that is permanently attached and/or incorporated into a standard-size truck or trailer or similar transportation means. A portable tower may be reconfigurable, for example by folding or tilting, between a use configuration and a transportation configuration, or it may permanently occupy a single configuration.

As used herein, the term "self-standing tower" refers to any tower that does not rely on external guy wires to provide structural integrity or remain upright.

As used herein, the term "S4" stands for "self-standing and self-supporting."

As used herein, the term "S4RD" stands for "self-standing, self-supporting, and rapid-deployment."

As used herein, the term "tower" refers to any structure that is taller than it is wide. A "tower," as that term is used herein and without further qualification, may be self-supporting or cantilevered, or it may be supported by stays or guys.

As used herein, the term "tower foundation" refers to a substantially permanent in-ground or underground structure adapted to support and provide structural integrity to a tower to ensure that the tower does not collapse or overturn.

Ballast base systems of the present invention comprise one or more ballast base blocks. In an exemplary embodiment, each ballast base block is formed of concrete and weighs at least about 2,500 pounds. The one or more ballast base blocks are arranged around a circumference of a tower, such that the tower's resistance to overturning moments caused by wind and other extrinsic forces is substantially the same for any given direction of the extrinsic force.

Although the most typical embodiments of the ballast base system of the present invention may employ about four ballast base blocks, embodiments may employ any number of ballast base blocks, including, by way of non-limiting example, one ballast base block, two ballast base blocks, three ballast base blocks, four ballast base blocks, or more than four ballast base blocks. The use of a single ballast base blocks in the ballast base system may require the single ballast base block to be larger and/or heavier than ballast base blocks used in ballast base systems employing two or more ballast base blocks, but this may be desirable in particular applications, such as, by way of non-limiting example, when the tower to be supported has a relatively low height-to-width ratio, i.e. has a cross-sectional diameter nearly as great as its height.

Regardless of the weight or number of the ballast base blocks, the ballast base system must provide sufficient ballast to resist overturning moments and keep the tower upright and secured to the ground when the tower is subjected to wind or another extrinsic force. Those of ordinary skill in the art will understand how to calculate the overturning moment of a particular tower under particular conditions, and thus the amount of ballast needed to resist the overturning moment, based on such factors as the height, weight, and circumference of the tower and the amount of force typically imparted by, for example, wind. Ballast base systems of the present invention can ensure that a tower remains upright and secured to the ground in sustained winds of at least about 60 miles per hour.

In addition to the total amount of ballast provided, ballast base systems must also be configured to distribute the ballast substantially uniformly about a circumference of the tower. This is accomplished by ensuring that the ballast base blocks are placed at sufficient distances from a center of the tower and in a pattern or cross-section that provides substantially uniform ballast across the circumference of the tower. Particularly, in some embodiments employing three or more ballast base blocks, the ballast base blocks may be arranged so as to form a regular polygon circumscribing the circumference of the tower and having a number of sides that is the same as the number of ballast base blocks, but any suitable arrangement of ballast base blocks may be used. The number and configuration of ballast base blocks will generally depend on the height and weight of the tower to be secured, with the number and total combined weight of the ballast base blocks generally increasing with increasing tower height.

Ballast base systems of the present invention further comprise at least one pendant support, interconnecting the ballast base block(s) to the tower itself. Where there is more than one pendant support, the pendant supports may all interconnect to the tower at a single point, or may each interconnect to the tower at a separate point. Pendant supports may be permanently fixed, for example by being welded, to the ballast base block, or may be selectively attachable and detachable to and from the ballast base block by any suitable means. Pendant supports may be I-beams or any other suitable structural member, including but not limited to steel tube, graphite composite, and fiberglass. It may generally be desirable, but not necessary, for two or more pendant supports to be interconnected at intermediate points between the tower and the ballast base blocks, so as to provide added rigidity and to enable the ballast base system as a whole to operate as a single integrated structural unit.

In an exemplary embodiment, a ballast base block is a concrete cylinder, having a diameter of about 60 inches, a height of about 20 inches, and a weight of about 5,000 pounds. In a first configuration or ballast base system employing this ballast base block, which may be suitable for towers of between about 30 and about 70 feet (e.g. 40 feet, 52 feet, 60 feet) in height, four ballast base blocks are arranged in a square pattern around the circumference of the tower, with a center-to-center distance between ballast base blocks of about 16 feet. In a second configuration or ballast base system employing this ballast base block, which may be suitable for towers of between about 70 and about 96 (e.g. 80 feet, 92 feet) feet in height or for towers of lesser height in high-wind areas, four ballast base blocks are arranged in a square pattern around the circumference of the tower, with a center-to-center distance between ballast base blocks of about 30 feet. In a third configuration or ballast base system employing this ballast base block, which may be suitable for towers of at least about 96 feet (e.g. 100 feet, 120 feet) in height, eight ballast base blocks are arranged in a pattern of two concentric squares around the circumference of the tower, wherein four inner ballast base blocks form an inner square with a center-to-center distance between ballast base blocks of about 30 feet and four outer ballast base blocks form an outer square with a center-to-center distance between ballast base blocks of about 44 feet.

In another exemplary embodiment, a ballast base block is a concrete cylinder, having a diameter of about 96 inches, a height of about 12 inches, and a weight of about 7,500 pounds. This ballast base block embodiment may be particularly suitable for towers of no more than about 30 feet (e.g. 10 feet, 12 feet, 20 feet, 24 feet, 30 feet) in height, for which a single heavier ballast base block, disposed directly below the tower, may represent the most effective ballast base system.

Though the exemplary ballast base blocks described above are made primarily of concrete, ballast base blocks of the present invention may be made of any suitable material or materials providing sufficient weight. By way of non-limiting example, a liquid bladder holding a suitable weight, e.g. about 5,000 pounds or about 7,500 pounds, of water, a water/glycol mixture, oils, or other liquid(s) may be desirable as an alternative, or in addition to, concrete ballast base blocks. Liquid bladder ballast base blocks may be particularly desirable for use in, by way of non-limiting example, very remote areas, situations where many ballast base blocks must be rapidly deployed by a single truck or trailer, and/or environments where reuse or frequent movement of ballast base blocks is desirable. Liquid bladder ballast base blocks may thus lend themselves particularly well to use in, by way of non-limiting example, disaster relief and other emergency situations.

Regardless of the materials of which they are made, ballast base blocks may further take any suitable and/or desirable shape. By way of non-limiting example, ballast base blocks may have a circular or L-shaped horizontal cross-section. A vertical thickness of the ballast base block may be substantially uniform throughout, or may vary to accommodate, by way of non-limiting example, uneven ground.

In addition to the ballast base systems described herein, the present invention provides OSHA-compliant towers that enable a technician to more safely and more conveniently climb, equip, and maintain the tower. The towers of the present invention present a four-sided structure wherein one of the four sides provides a ladder functionality enabling a technician to climb the tower. The four sides of the tower enclose a quadrilateral interior area having a width and a depth, each of the width and the depth preferably being between about 27 inches and about 32 inches. These width and depth ranges are sufficient to accommodate a technician while allowing the interior area of the tower to serve as a man cage for the ladder, as may be required by OSHA and similar workplace safety regulations, such that the technician may climb on the "inside" of the tower structure.

The side of the tower comprising the ladder functionality comprises horizontal rungs allowing a technician to climb the ladder. To comply with OSHA and similar workplace safety regulations and provide ease and comfort of use for the technician, embodiments of the tower of the present invention preferably provide rungs at vertical intervals of no more than about 12 inches, most preferably about every 10.5 inches. A spacing of 10.5 inches is particularly desirable because it allows the ladder to comply with current OSHA regulations, which require that any platform be surrounded by railings at 21 inches and 42 inches above the standing surface of the platform, without requiring additional structural elements.

Towers of the present invention may be made of any suitable material and may have any suitable structure. By way of non-limiting example, in some embodiments, the tower may comprise a steel lattice, wherein a vertical frame of the tower structure comprises 2-inch square steel tubing and ladder rungs and horizontal and diagonal supports of the tower structure comprise 1-inch round steel tubing. This steel lattice structure has the benefit of being easily, inexpensively, and rapidly manufactured, assembled, and/or disassembled with close tolerances, by the use of relatively simple tools and techniques (e.g. tack welding), and under difficult conditions, as may be the case, for example, in the wake of a natural disaster. Such a steel lattice structure may comprise pieces of round or square tubing that extend outwardly from the four-sided tower structure, to provide more space for antennas or aerials to be mounted on the tower. Other materials and structures may provide other advantages, as will be understood by those of ordinary skill in the art, and such additional or alternative structures are within the scope of the present invention.

Towers of the present invention may further comprise one or more platforms that enable a technician to stand and securely work on the tower above ground level. Tower platforms of the present invention may take any suitable form. In some embodiments, the platform may be a T-shaped platform, whereby the technician may step to either side to gain the platform. In other embodiments, the platform may wrap around the exterior of the tower structure, whereby the technician may step to one side to gain the platform and then walk around the entire circumference of the tower to accomplish a task. In still other embodiments, the platform may have an inverted L shape and extend outwardly from one side of the tower, enabling the technician to step to one side to gain the platform. In these and other embodiments, a gap or vacancy in the steel lattice structure may enable the technician to move from the ladder to the platform without bending or crouching unsteadily. The platform may further comprise a reconfigurable "trap door" safety feature that the technician may lower to form a horizontal obstacle in the interior space of the tower, eliminating the possibility that the technician will fall down through the interior of the tower.

Towers of the present invention may, but need not, be modular and/or stackable, such that a tower of a desired height may be assembled by stacking and/or interconnecting two or more tower sections of lesser height. Such a feature may be particularly valuable for assembling towers of sufficient height that two or more platforms are required. By way of non-limiting example, where a tower height of 75 feet is desired and local safety regulations or other considerations dictate that platforms must be provided at vertical intervals of about 30 feet, a tower may be assembled by stacking two 30-foot tower sections comprising top platforms below a shorter 15-foot tower section with no platform; a 75-foot tower with platforms at 30 and 60 feet above ground level is thus achieved. Stacking or interconnection of tower sections may be aided by providing mounting pads or posts on the top of a tower section, into or onto which the bottom of a succeeding section may stack or interconnect, as will be understood by those of ordinary skill in the art.

Towers of the present invention may further comprise a "skin" or "wrap" that covers all or a portion of the exterior surface of the tower, as may be desirable to camouflage the tower or make the tower more aesthetically pleasing. The "skin" or "wrap" may comprise, by way of non-limiting example, a metal or composite quarter panel that is selectively attachable to a side or face of the tower, and may have a length equal to the height of the tower, so that the entire tower may be camouflaged or wrapped with a single tier of panels, or less than the height of the tower, so that the entire tower may be camouflaged or wrapped with several tiers of panels or so that selected portions of the tower may remain uncamouflaged or unwrapped.

Those of ordinary skill in the art will understand and appreciate that the ballast base system of the present invention and the tower design of the present invention may be used separately or together, either of which is within the scope of the present invention. By way of non-limiting example, ballast base systems of the present invention may be employed to secure a tower of a previously known design (e.g. mono-pole, conventional steel lattice, welded, bolt-together, self-standing, guyed, cosmetic, etc.), and towers according to the present invention may be secured by conventional or previously known means, such as a permanent foundation, and ballast base systems and towers according to the present invention may be used together. All of the above combinations, and others, are contemplated by and within the scope of the present disclosure.

In embodiments combining a ballast base system of the present invention and a tower of the present invention, a method for placing the ballast base system and interconnecting the tower to the ballast base system is disclosed. Such a method may, in some embodiments, be accomplished in less than three hours, preferably between about 90 minutes and 2 hours.

Embodiments of the present invention may comprise additional elements, including but not limited to prewired and/or preinstalled antennas and conduits, patch panel boxes at ground and/or platform level, equipment sheds, battery boxes, custom-colored powder coating or painting, lockable anti-climb panels, and an integrated conveyance (e.g. truck or trailer). Those of ordinary skill in the art will understand and appreciate other additional elements within the scope of the invention.

Applications of the present invention include, but are not limited to, small communications dishes, broadband networks, wireless internet networks, point-to-point networks, security networks, two-way communications, public and emergency networks, cellular networks, oil field and energy extraction operations, agricultural operations, supplemental capacity to support existing towers, temporary area lighting, special events, temporary venues, and disaster relief. In these and other applications, the tower may comprise a communications tower, a control tower, a light tower, or an observation tower. Those of ordinary skill in the art will understand and appreciate other applications within the scope of the invention.

Systems and methods of the present invention may provide a tower structure suitable for precise mounting of backhaul communications equipment, and may enable backhaul communications equipment or other equipment to operate at carrier grade reliability. Towers provided according to the present invention may be self-standing, S4, or S4RD, and may be movable and/or portable. Other characteristics of embodiments of the invention will additionally be apparent to those of ordinary skill in the art.

Those of ordinary skill in the art will understand and appreciate that stated dimensions of the ladder and other components of the tower and/or ballast base systems disclosed herein may be modified to comply with applicable local regulations, or for any other reason, to make the invention suitable for a particular application. Such modifications and adjustments are within the scope of the present invention, and accordingly embodiments of the present invention may be larger, smaller, or differently configured, in any one or more dimensions, than the exemplary embodiments disclosed herein, without departing from the scope of the present invention.

Figure 1B:
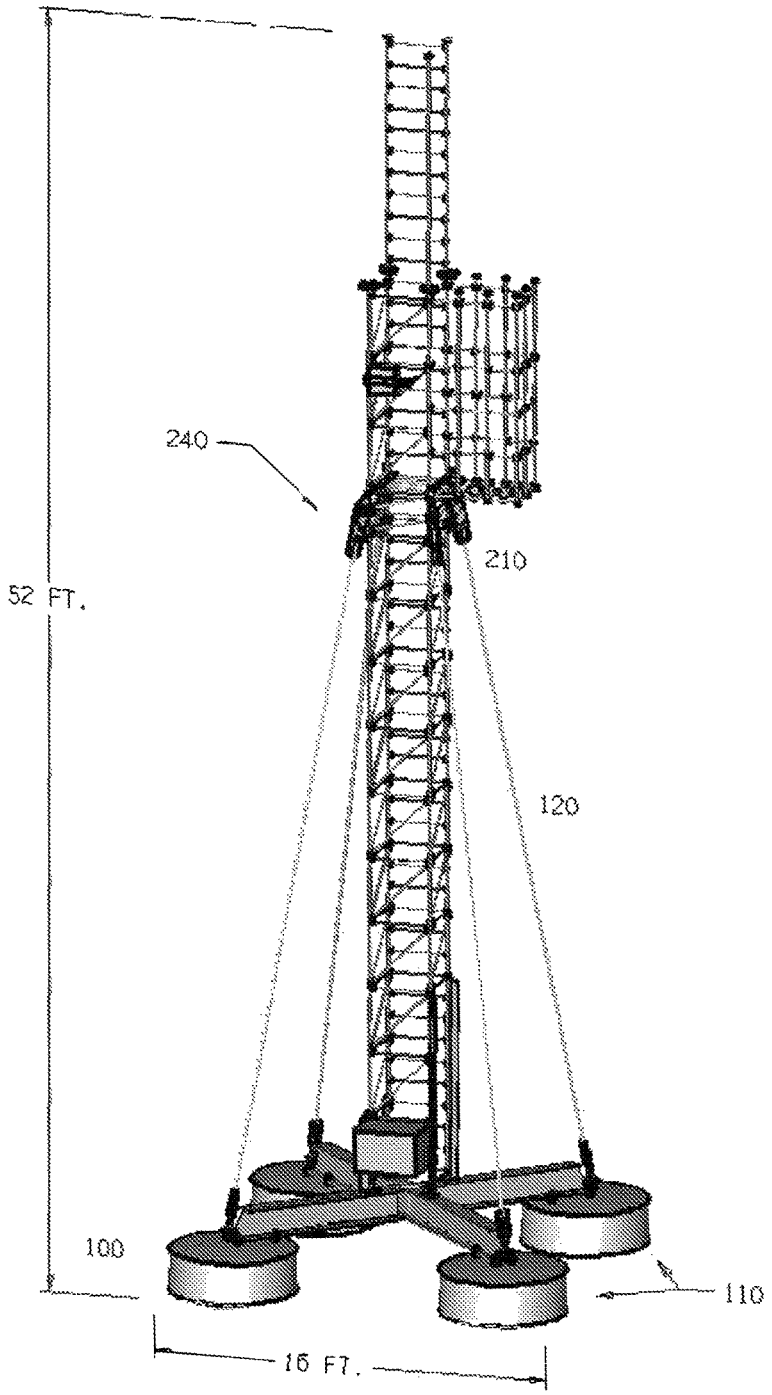
Figure 1C:
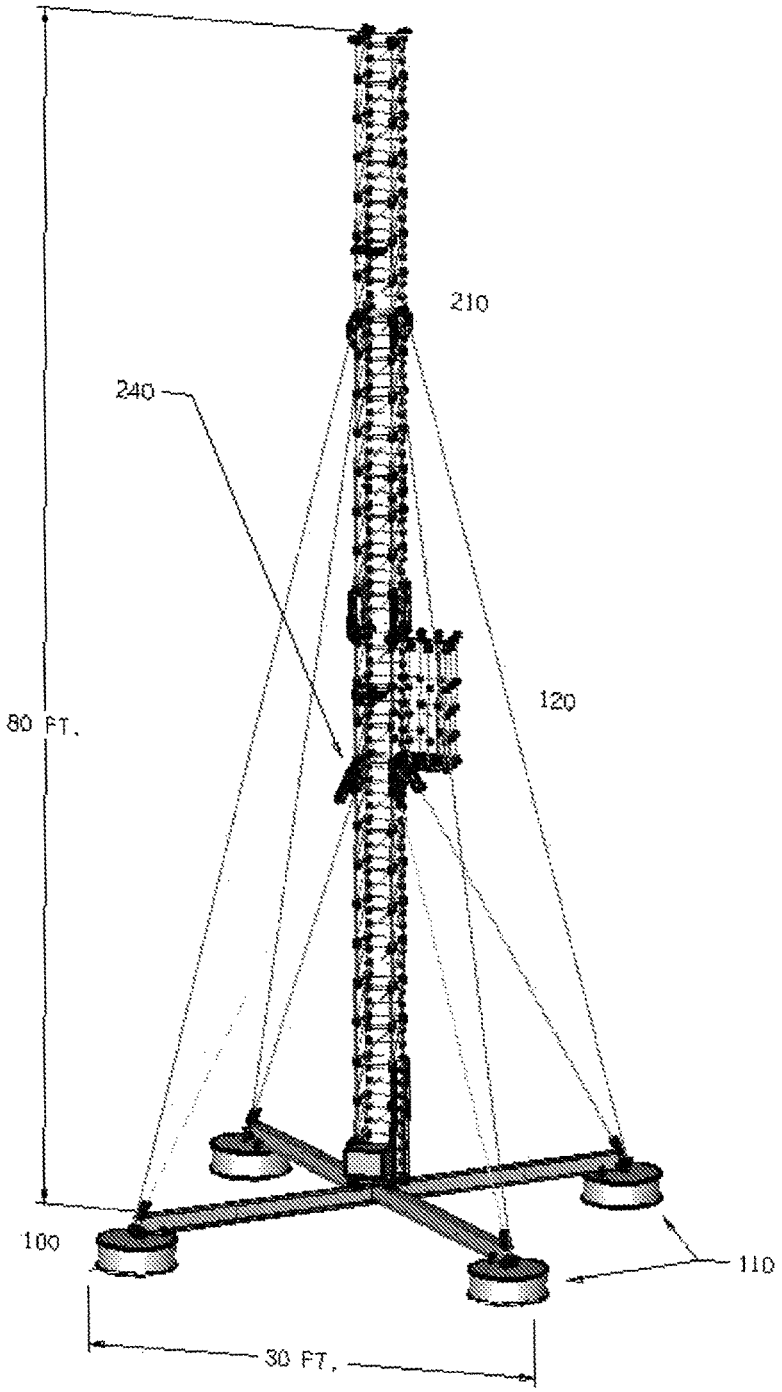

Referring now to FIGS. 1A, 1B, and 1C, towers 200 of 40 feet, 52 feet, and 80 feet, respectively, in height and ballast base systems 100 in conjunction therewith are illustrated. The ballast base systems 100 comprise ballast base blocks 110 and pendant supports 120 interconnecting the ballast base blocks 110 to upper portions 210 of the towers 200. In the embodiments illustrated in FIGS. 1A, 1B, and 1C, each ballast base block 110 weighs about 5,000 pounds; the weight of each ballast base block 110 is transmitted via the corresponding pendant support 110 to the upper portion 210 as a downward force sufficient to provide a pre-load onto the Ballast Base system that provides stiffness and to overcome an overturning moment imparted on the tower by a sustained wind of at least about 60 miles per hour. Each tower 200 comprises a ladder face and three structural faces, the ladder face comprising a plurality of rungs spaced apart at vertical intervals of about 10.5 inches. The ladder face and three structural faces of the tower 200 enclose a rectangular interior volume sufficiently large for a user to climb the ladder while occupying the rectangular interior volume, but sufficiently small to allow the three structural faces to act as a man cage for the user while climbing the ladder. Each of the three illustrated towers 200 further comprises a platform 240 at a height of about 30 feet.

As is illustrated in FIGS. 1A, 1B, and 1C, the ground area occupied by the ballast base system 100 may, and preferably does, vary with the height of the tower 200, i.e. the ballast base system 100 occupies a greater area as the height of the tower 200 increases. In the illustrated embodiments, an area 16 feet square is generally suitable for a tower of 40 or 52 feet in height, and an area 30 feet square is generally suitable for a tower of 80 feet in height, but those of ordinary skill in the art will understand how to choose an appropriate area and configuration of the ballast base system 100 based on the height of the tower 200; by way of non-limiting example, an area about 16 feet square may be generally suitable for towers of between about 30 and about 70 feet in height, an area about 30 feet square may be generally suitable for towers of between about 70 and about 96 feet in height, and an area about 44 feet square may be generally suitable for towers of between about 96 and about 120 feet in height. Although the ballast base systems 100 illustrated in FIGS. 1A, 1B, and 1C comprise four ballast base blocks 110 arranged in a square pattern, any number and arrangement of ballast base blocks 110 suitable to resist an overturning moment imparted on the tower 200 by a wind of at least about 60 miles per hour may be used.

Figure 2:
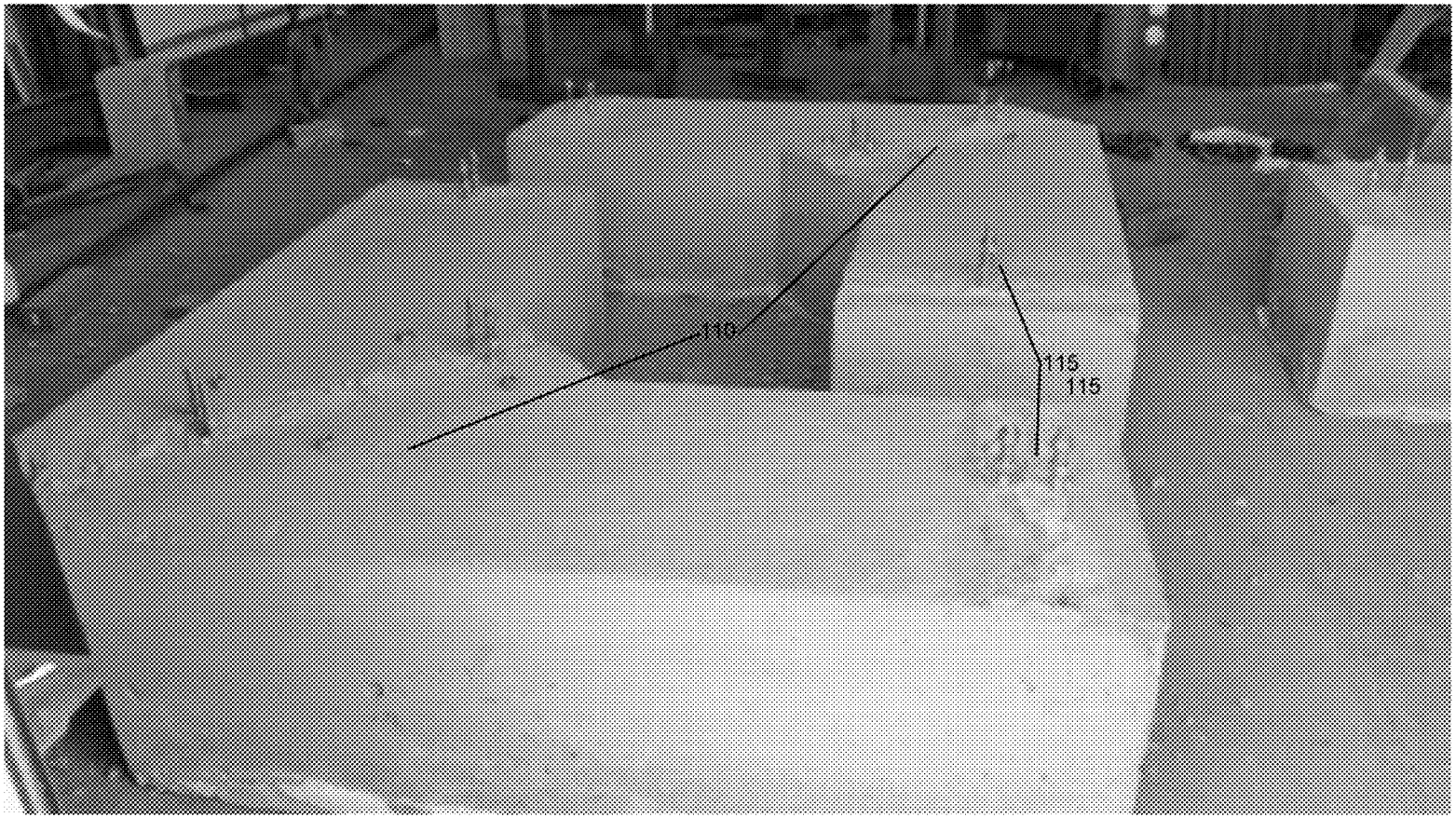
FIG. 2 is an illustration of L-shaped ballast base blocks, according to embodiments of the present invention.

Referring now to FIG. 2, L-shaped concrete ballast base blocks 110 are illustrated. Ballast base blocks having shapes other than cylinders may be provided instead of or in addition to cylindrical ballast base blocks in ballast base systems 100, and may be advantageous where, for example, the terrain slopes steeply in the immediate vicinity of one or more ballast base blocks 110 and a ballast base block 110 having a contoured shape is thus desirable. The L-shaped ballast base blocks 110 illustrated in FIG. 2 comprise connection points 115, to which pendant supports 120 may be interconnected.

Figure 3:
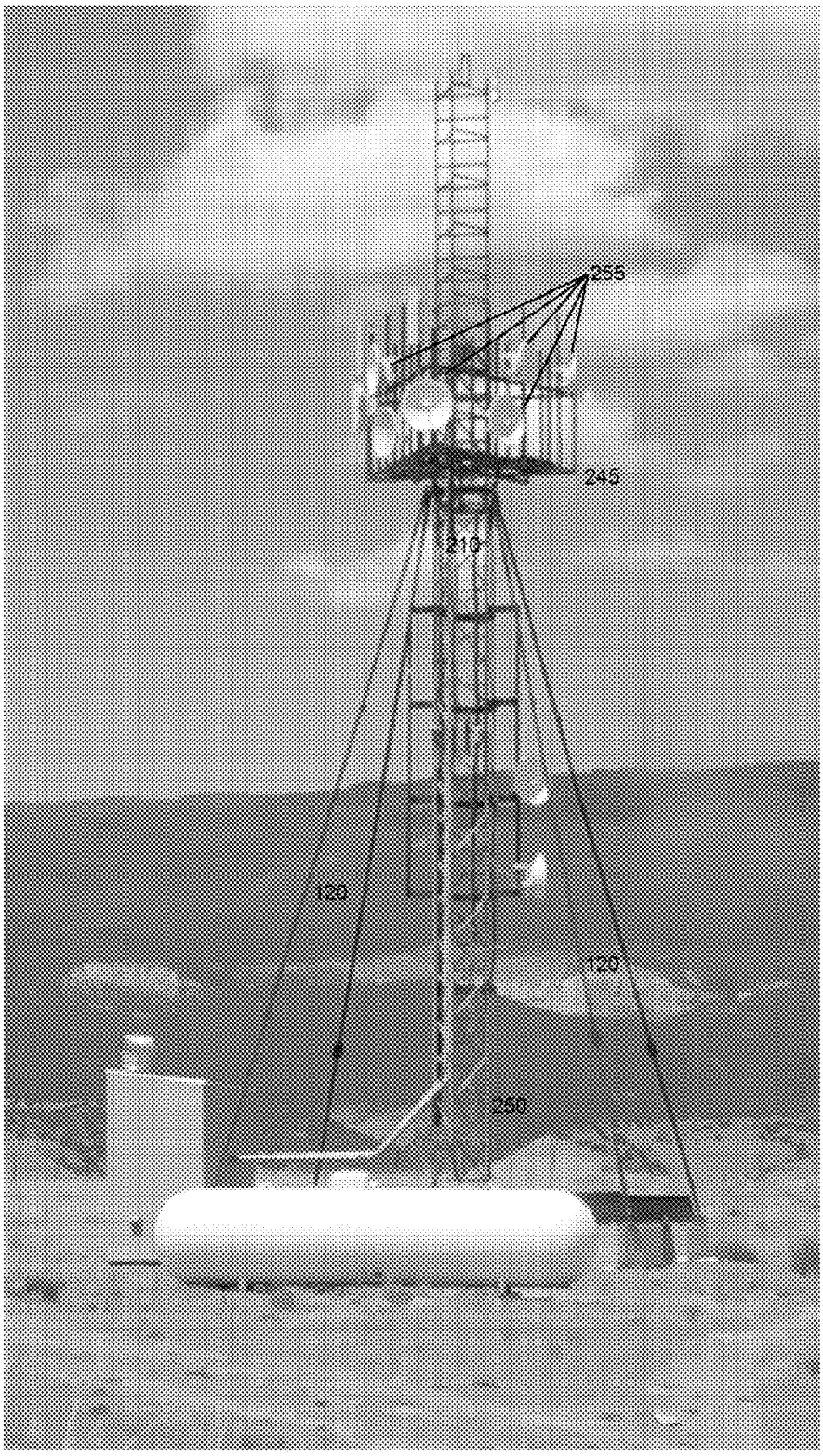
FIG. 3 is an illustration of a communications tower comprising a wraparound external platform and a plurality of mounted antennas, according to embodiments of the present invention.

Referring now to FIG. 3, a communications tower 250 comprising a wraparound external platform 245 and a plurality of mounted antennas 255 is illustrated. Pendant supports 120 extending from ballast base blocks (not marked) interconnect to an upper portion 210 of the communications tower 250 just below the platform 245.

Figure 4:
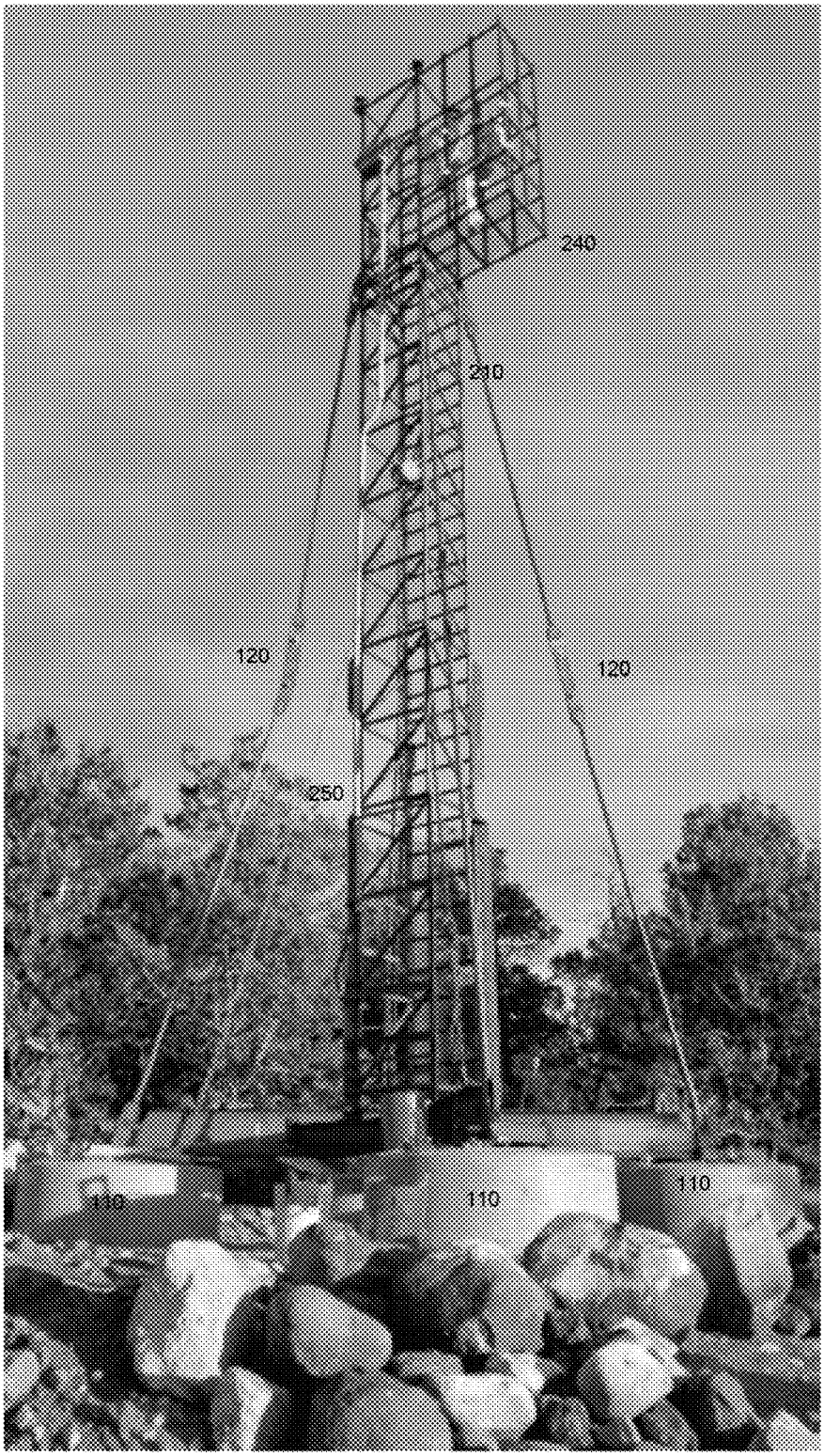
FIG. 4 is an illustration of a ballast base system and a communications tower, according to embodiments of the present invention.

Referring now to FIG. 4, a ballast base system and a communications tower 250 are illustrated. Similar to the embodiment illustrated in FIG. 1A, the ballast base system comprises cylindrical concrete ballast base blocks 110 and pendant supports 120 interconnecting to an upper portion 210 of the tower 200 just below a platform 240 that is disposed at the top of the tower 200.

Figure 5:
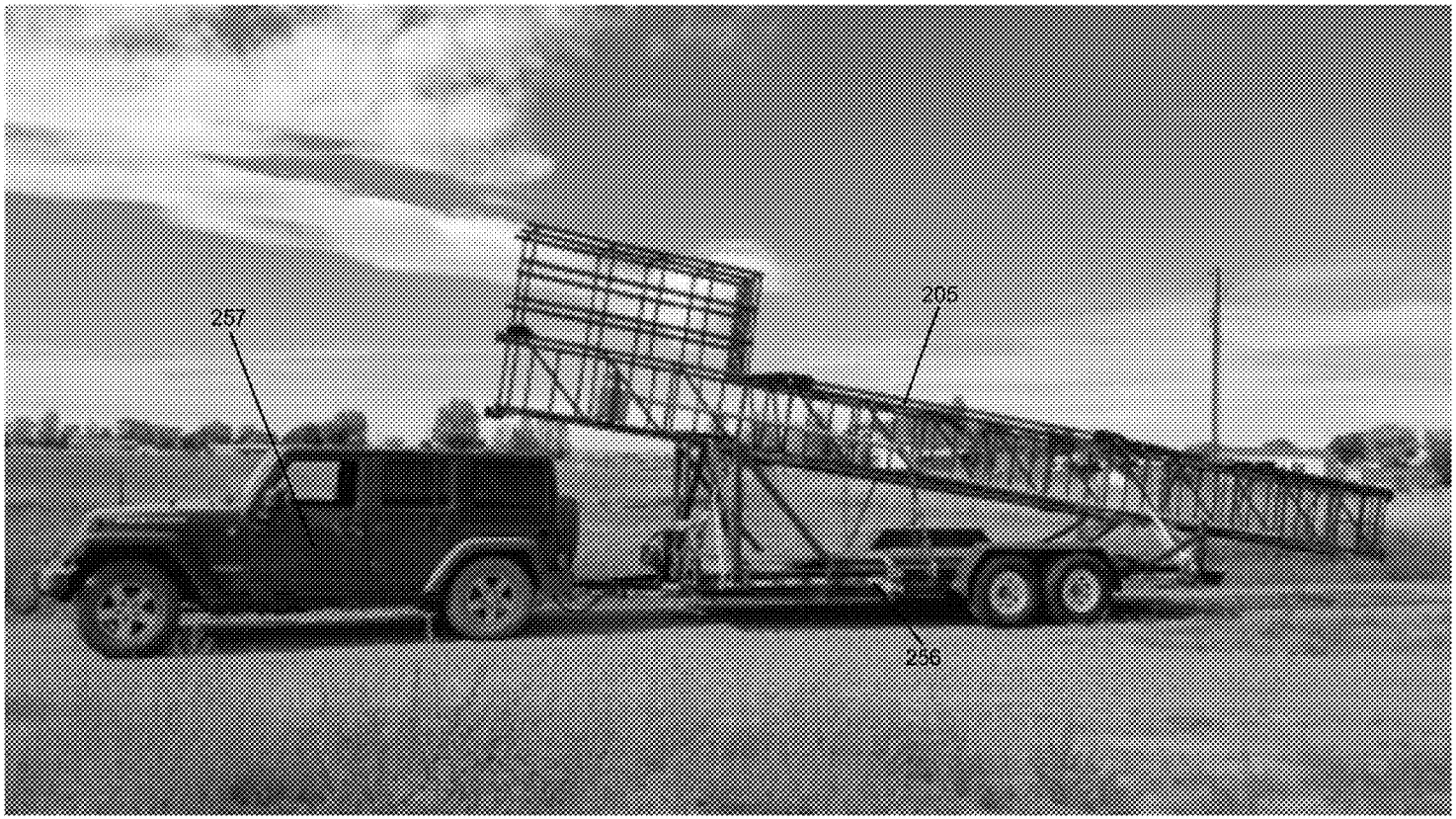
FIG. 5 is an illustration of a movable tower, according to embodiments of the present invention.

Referring now to FIG. 5, a movable tower 205 is illustrated. The movable communications tower 205, as illustrated, is in a transportation configuration, lying "sideways" while mounted on a standard flatbed trailer 256. As illustrated in FIG. 5, the movable tower 205 is light enough that the combined weight of the movable tower 205 and flatbed trailer 256 can be easily towed by a standard passenger vehicle 257. Once transported to a desired location, the movable tower 205 can be offloaded from the flatbed trailer 256 and repositioned into an upright use position in a matter of minutes using standard equipment.

Figure 6:
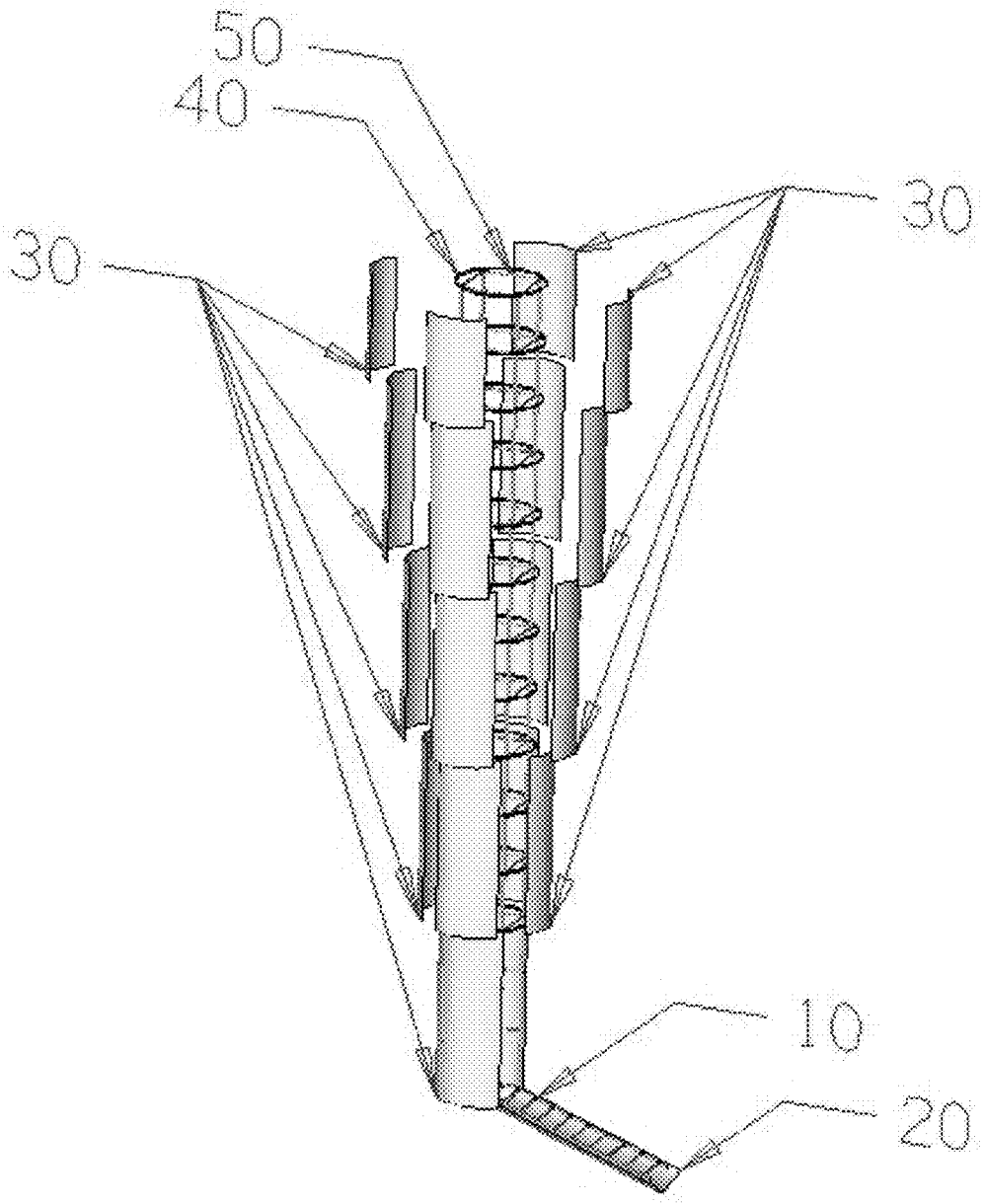
FIG. 6 is an illustration of a tower comprising a skin, according to embodiments of the present invention.

Referring now to FIG. 6, a tower 50 comprising a skin is illustrated. The tower 50 further comprises a tilt-down door 10, made of steel tubing and reconfigurable between a down/open position and an up/closed position. When the tilt-down door 10 is in the up/closed position, it may be locked into place, and in some preferred embodiments may comprise part of the ladder face of the tower 50, in which case it may comprise rungs and be climbed as a lower portion of the ladder face from inside the enclosed rectangular interior volume. Attached to the tilt-down door 10 is a door skin panel 20, which may comprise a thin sheet of metal or other material (e.g. aluminum, fiberglass, Kevlar, etc.) and provide an aesthetic or camouflaging effect when the tilt-down door 10 is in an up/closed position. Similar to the door skin panel 20, tower skin panels 30 are attached to the tower 50 at varying heights and distances away from the rectangular interior volume to provide an aesthetic or camouflaging effect. In this embodiment, the tower skin panels 30 are attached to the tower 50 by tower skin attachment rings 40, but any suitable attachment mechanism, including ribs, bolts, or screws, may be used to secure door skin panel 20 and tower skin panels 30 to the tower 50.

Figure 7B:
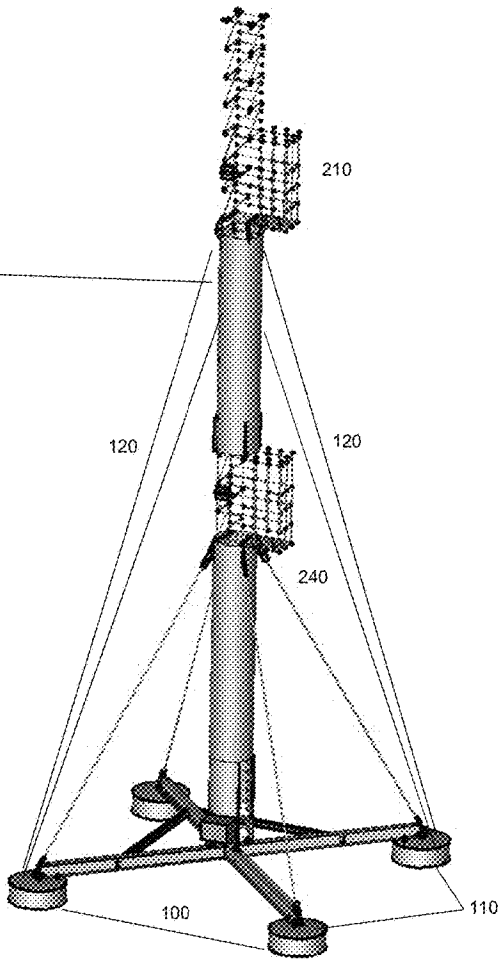
FIGS. 7A and 7B are illustrations of towers of 40 feet and 80 feet, respectively, in height comprising skins and in conjunction with ballast base systems, according to embodiments of the present invention.
Figure 7A:
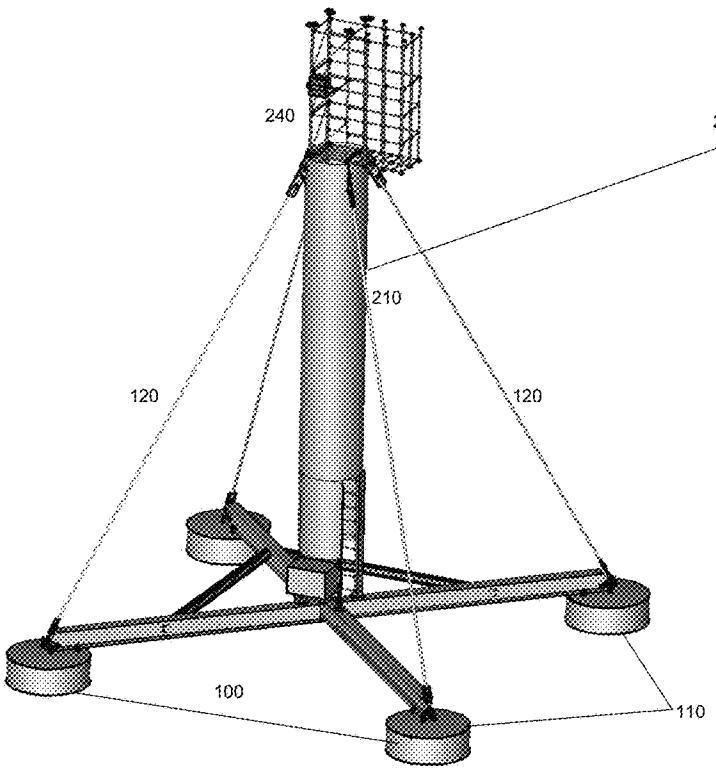

Referring now to FIGS. 7A and 7B, towers 200 of 40 feet and 80 feet, respectively, in height comprising tower skin panels 30 and in conjunction with ballast base systems 100 are illustrated. The embodiments of FIGS. 7A and 7B are similar to the embodiments of FIGS. 1A and 1C, respectively, except for the presence of tower skin panels 30.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

The present inventions, in various embodiments, include components, methods, processes, systems and/or apparatuses substantially as depicted and described herein, including various embodiments, sub combinations, and subsets thereof. Those of skill in the art will understand how to make and use the present inventions after understanding the present disclosure. The present inventions, in various embodiments, include providing devices and processes in the absence of items not depicted and/or described herein or in various embodiments hereof, including in the absence of such items as may have been used in previous devices or processes, e.g., for improving performance, achieving ease and\or reducing cost of implementation.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A four-sided communications tower structure, comprising:

a ladder face, comprising a plurality of rungs, the rungs spaced apart at vertical intervals; and three structural faces, wherein the ladder face and the three structural faces enclose an interior volume having a width and a depth, wherein a user may climb the ladder while occupying the interior volume, whereby the three structural faces may act as a man cage for the user while climbing the ladder; and a wraparound external platform disposed on the four-sided communications tower structure;

a plurality of mounted antennas, wherein the plurality of mounted antennas is mounted on the wraparound external platform;

an outer skin covering, wherein the outer-skin covering comprises a plurality of tower-skin panels; and a tilt-down door, wherein the tilt-down door comprises steel tubing at least partially covered by at least one tower-skin panel, the tilt-down door is configurable between a down/open position and an up/closed position.

2. A four-sided communications tower structure, comprising:

a ladder face, comprising a plurality of rungs, the rungs spaced apart at vertical intervals; and three structural faces, wherein the ladder face and the three structural faces enclose an interior volume having a width and a depth, wherein a user may climb the ladder while occupying the interior volume, whereby the three structural faces may act as a man cage for the user while climbing the ladder; and a wraparound external platform disposed on the four-sided communications tower structure;

a plurality of mounted antennas, wherein the plurality of mounted antennas is mounted on the wraparound external platform, wherein the rungs of the ladder face are spaced apart at vertical intervals of about 10.5 inches, wherein the ladder face extends a length equal to the length of the three structural faces, and wherein the ladder face and the three structural faces enclose an interior volume having a width of between about 27 inches and about 32 inches, and a depth of between about 27 inches and about 32 inches.

3. The tower structure of claim 1, further comprising at least one pendant support, wherein the tower structure is a steel lattice tower structure, and wherein the at least one pendant support interconnects to an upper portion of the steel lattice tower structure.

4. The tower structure of claim 3, wherein the ladder face further comprises a vertical frame and each of the structural faces comprises a vertical frame and a plurality of horizontal and diagonal supports, wherein the vertical frames comprise 2-inch steel tubing and the rungs of the ladder face and the horizontal and diagonal supports comprise 1-inch steel tubing.

5. The tower structure of claim 3, further comprising at least one horizontal platform at a height above ground level, enabling the user to stand securely at the height, wherein the at least one pendant support interconnects to an upper portion of the tower just below the wraparound external platform.

6. The tower structure of claim 5, wherein the four-sided communications tower structure is movable, and wherein the movable four-sided communications tower structure is securely configured in a supine position and disposed in a standard flatbed trailer.

7. The tower structure of claim 1, comprising at least two modular, selectively interconnected tower sections.

8. The tower structure of claim 1, wherein the tilt-down door further comprises a locking mechanism capable of securing the tilt-down door to the tower structure when the tit-down door is configured in the up/closed position.

9. The tower structure of claim 1, wherein the tilt-down door comprises at least a portion of the ladder face of the tower, wherein the tilt-down door comprises rungs capable of being climbed from inside the enclosed interior volume.

10. The tower structure of claim 1, wherein the at least one tower-skin panel is selected from the group consisting of fiberglass, sheet of metal, aluminum, fiberglass, and Kevlar.

11. The tower structure of claim 1, wherein the plurality of tower-skin panels is securely attached to the tower structure at varying heights and distances away from the interior volume to provide a camouflaging effect.

12. The tower structure of claim 1, wherein the plurality of tower-skin panels is securely attached to the tower structure by tower-skin attachment rings.

13. The tower structure of claim 1, wherein the plurality of tower-skin panels is securely attached directly to the four-sided communications tower structure by a fastening mechanism selected from the group consisting of ribs, bolts, and screws.

14. A four-sided communications tower structure, comprising:

a ladder face, comprising a plurality of rungs, the rungs spaced apart at vertical intervals; and three structural faces, wherein the ladder face and the three structural faces enclose an interior volume having a width and a depth, wherein a user may climb the ladder while occupying the interior volume, whereby the three structural faces may act as a man cage for the user while climbing the ladder, wherein the rungs of the ladder face are spaced apart at vertical intervals of about 10.5 inches, wherein the ladder face extends a length equal to the length of the three structural faces, and wherein the ladder face and the three structural faces enclose an interior volume having a width of between about 27 inches and about 32 inches, and a depth of between about 27 inches and about 32 inches; and a wraparound external platform disposed on the four-sided communications tower structure;

a plurality of mounted antennas, wherein the plurality of mounted antennas is mounted on the wraparound external platform;

an outer skin covering, wherein the outer-skin covering comprises a plurality of tower-skin panels; and a tilt-down door, wherein the tilt-down door comprises steel tubing at least partially covered by at least one tower-skin panel, the tilt-down door is configurable between a down/open position and an up/closed position.

15. The tower structure of claim 14, wherein the tilt-down door further comprises a locking mechanism capable of securing the tilt-down door to the tower structure when the tit-down door is configured in the up/closed position.

16. The tower structure of claim 14, wherein the tilt-down door comprises at least a portion of the ladder face of the tower, wherein the tilt-down door comprises rungs capable of being climbed from inside the enclosed interior volume.

17. The tower structure of claim 14, wherein the at least one tower-skin panel is selected from the group consisting of fiberglass, sheet of metal, aluminum, fiberglass, and Kevlar.

18. The tower structure of claim 14, wherein the plurality of tower-skin panels is securely attached to the tower structure at varying heights and distances away from the interior volume to provide a camouflaging effect.

19. The tower structure of claim 14, wherein the plurality of tower-skin panels is securely attached to the tower structure by tower-skin attachment rings.

20. The tower structure of claim 14, wherein the plurality of tower-skin panels is securely attached directly to the four-sided communications tower structure by a fastening mechanism selected from the group consisting of ribs, bolts, and screws.

* * * * *